US008434497B2

(12) United States Patent
Yanchev

(10) Patent No.: US 8,434,497 B2
(45) Date of Patent: May 7, 2013

(54) PACKAGE FOR CIGARETTES OF DIFFERENT SIZES AND/OR BRANDS

(75) Inventor: Yanko Yanchev, Pittsburg, PA (US)

(73) Assignee: Aiger Group AG, Zug (CH)

( * ) Notice: Subject to any disclaimer, the term of this patent is extended or adjusted under 35 U.S.C. 154(b) by 465 days.

(21) Appl. No.: 12/633,404

(22) Filed: Dec. 8, 2009

(65) Prior Publication Data

US 2010/0139676 A1 Jun. 10, 2010

Related U.S. Application Data

(60) Provisional application No. 61/120,972, filed on Dec. 9, 2008.

(51) Int. Cl.
*A24F 13/00* (2006.01)

(52) U.S. Cl.
USPC ..... 131/329

(58) Field of Classification Search ..... None
See application file for complete search history.

(56) References Cited

U.S. PATENT DOCUMENTS

| | | | | |
|---|---|---|---|---|
| 3,007,623 | A | 11/1961 | Clemens | |
| 3,039,671 | A | 6/1962 | Chiamardas | |
| 4,241,827 | A | 12/1980 | Focke | |
| 4,961,496 | A | 10/1990 | Focke et al. | |
| 5,480,025 | A | 1/1996 | Draucker et al. | |
| 7,155,882 | B2 * | 1/2007 | Ghini et al. | 53/444 |
| D545,493 | S | 6/2007 | Carter et al. | |
| 7,383,950 | B1 * | 6/2008 | Roberts et al. | 206/256 |
| 2007/0138036 | A1 | 6/2007 | Weiss et al. | |

FOREIGN PATENT DOCUMENTS

| | | | |
|---|---|---|---|
| CN | 201040641 | | 3/2008 |
| EP | 1801032 | A1 | 6/2007 |
| FR | 2820129 | | 1/2001 |
| JP | 2006333713 | A | 12/2006 |
| KR | 1020060048999 | A | 5/2006 |

OTHER PUBLICATIONS

International Search Report dated Jun. 25, 2010 corresponding to International Patent Application No. PCT/US2009/067155, 2 pages.

* cited by examiner

*Primary Examiner* — Michael J Felton
(74) *Attorney, Agent, or Firm* — Maier & Maier, PLLC

(57) ABSTRACT

A cigarette pack capable of carrying different-sized and different-branded cigarettes is disclosed. The cigarette pack may consist of a first portion, a second portion hingedly coupled to the first portion, and a top portion hingedly coupled to a sliding portion slidably disposed within the second portion. The cigarette pack may also include sleeves disposed within the first portion and second portion and configured to support cigarettes within the sleeve. The cigarette pack may also include a platform for supporting cigarettes within either of said portions.

1 Claim, 2 Drawing Sheets

PACKAGE FOR CIGARETTES OF DIFFERENT SIZES AND/OR BRANDS

RELATED APPLICATIONS

The present invention claims priority under 35 U.S.C. §120 to U.S. Provisional Patent Application No. 61/120,972 filed on Dec. 9, 2008, the disclosure of which is incorporated by reference herein in its entirety.

BACKGROUND

Cigarettes are commonly packaged and sold in packs containing about twenty cigarettes. The cigarettes are typically packaged such that the interstitial space between the cigarettes and the pack walls and between the cigarettes themselves is minimized, thus helping prevent damage to the cigarettes from impacts during transport. Consequently, though cigarettes are manufactured in a variety of lengths and diameters, the cigarettes contained in a single pack usually share a common, uniform length and diameter.

People may desire to smoke several varieties of cigarettes on any particular occasion. As different varieties or brands of cigarettes may have different lengths and diameters, one is typically required either to carry a separate pack for each variety of cigarettes that one desires to smoke, or to combine different types of cigarettes in a package designed for only one particular size of cigarette, which may result in damage to the cigarettes. Therefore, a cigarette pack that can conveniently and protectively carry cigarettes of different lengths, diameters, and brands is desired.

SUMMARY

According to at least one exemplary embodiment, a cigarette pack capable of carrying different-sized and different-branded cigarettes is disclosed. The cigarette pack may consist of a first portion, a second portion hingedly coupled to the first portion, and a top portion hingedly coupled to a sliding portion slidably disposed within the second portion. The cigarette pack may also include sleeves disposed within the first portion and second portion and configured to support cigarettes within the sleeve. The cigarette pack may also include a platform for supporting cigarettes within either of said portions.

BRIEF DESCRIPTION OF THE FIGURES

Advantages of embodiments of the present invention will be apparent from the following detailed description of the exemplary embodiments thereof, which description should be considered in conjunction with the accompanying drawings in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the terms "embodiments of the invention", "embodiment" or "invention" do not require that all embodiments of the invention include the discussed feature, advantage or mode of operation.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

Figure 1:
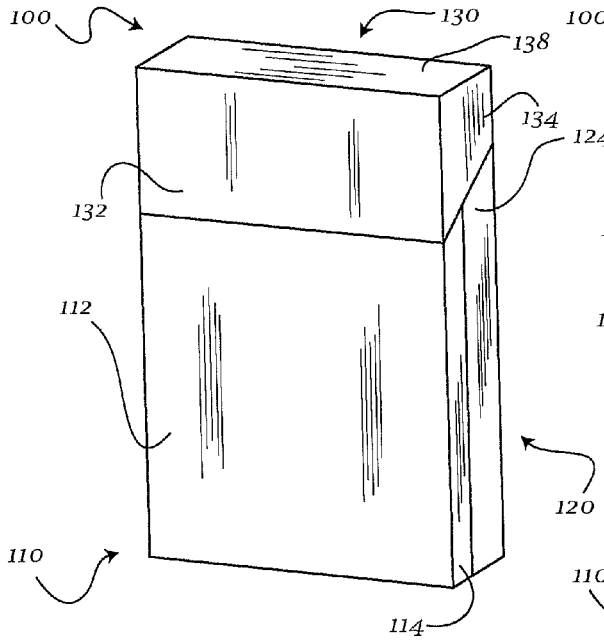
FIG. 1 is a front perspective view of an exemplary embodiment of a cigarette package in a closed configuration.
Figure 2:
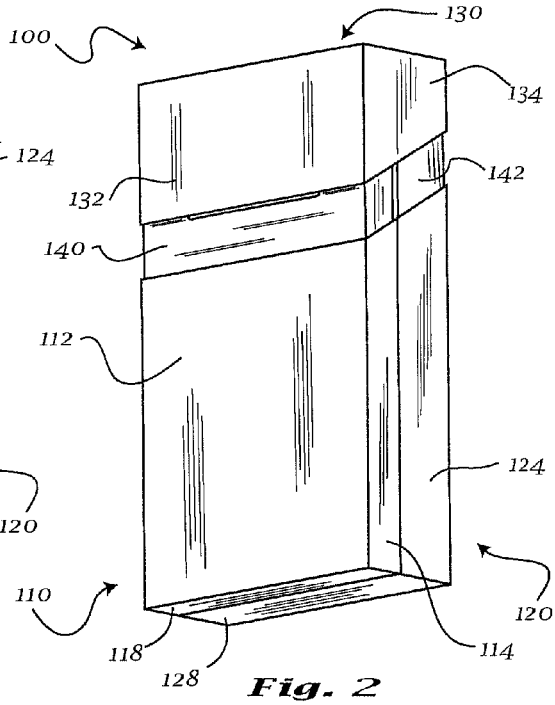
FIG. 2 is a front perspective view of an exemplary embodiment a cigarette package with a top portion slid upwards.
Figure 3:
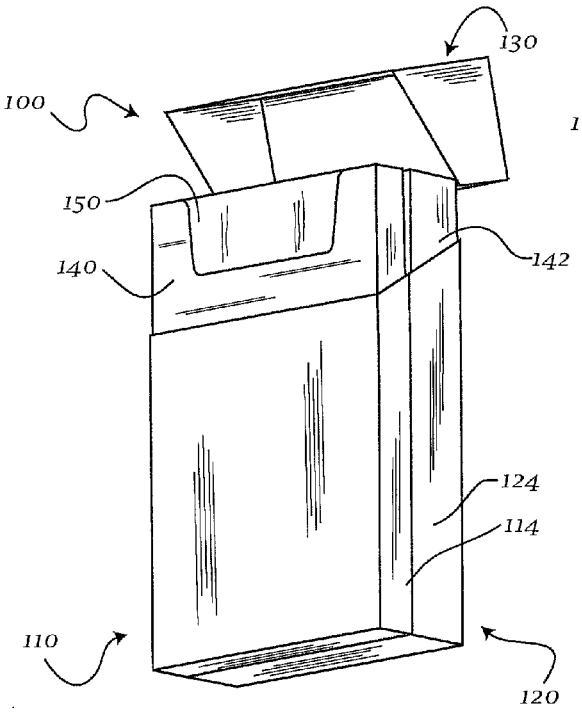
FIG. 3 is a front perspective view of an exemplary embodiment of a cigarette package with a top portion tilted rearwards.
Figure 4:
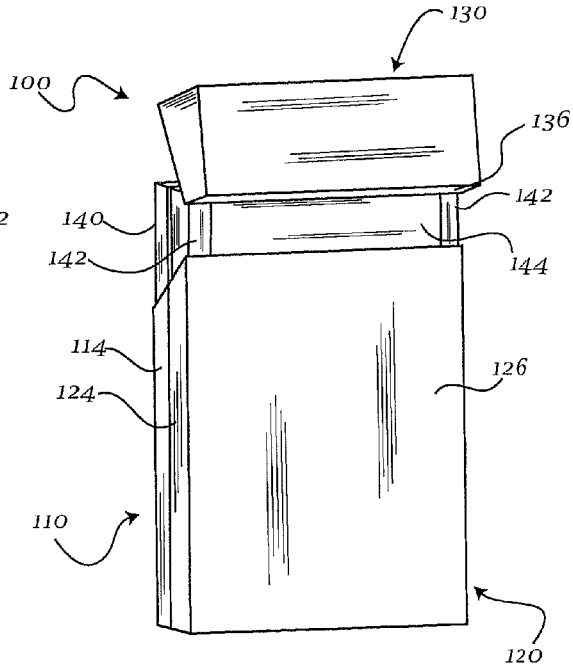
FIG. 4 is a rear perspective view of an exemplary embodiment of a cigarette package with a top portion tilted rearwards.
Figure 5:
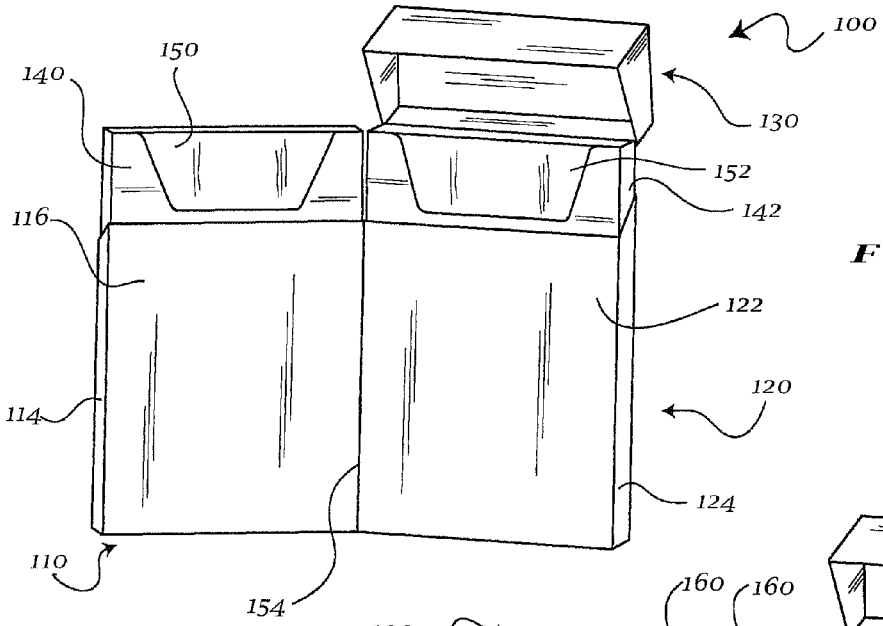
FIG. 5 is a front perspective view of an exemplary embodiment of a cigarette package in an open configuration.
Figure 6:
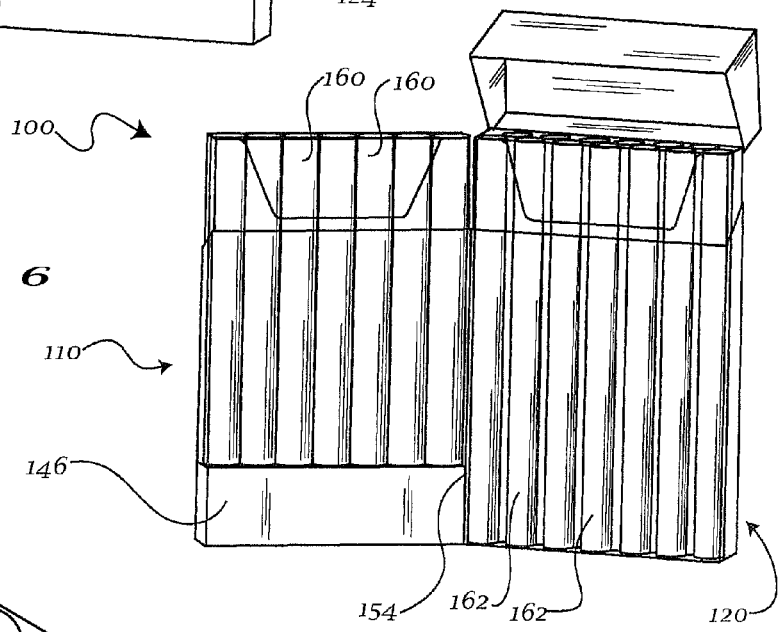
FIG. 6 is a front cutaway view of an exemplary embodiment of a cigarette package.
Figure 7:
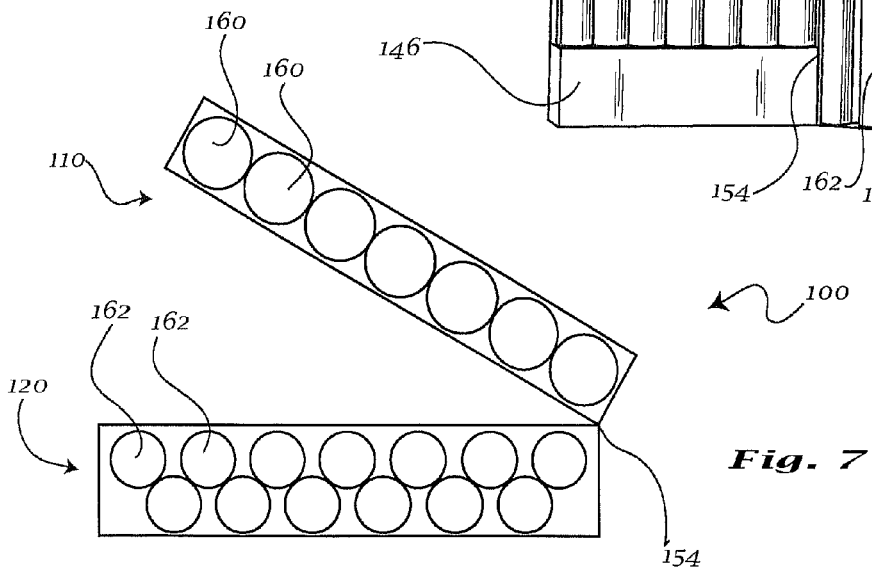
FIG. 7 is a top cutaway view of an exemplary embodiment of a cigarette package.

Referring to FIGS. 1-7, a cigarette package 100 is provided. Cigarette package 100 may be configured to accept cigarettes of different sizes and/or brands. Cigarette package 100 may include a first portion 110, a second portion 120 and a top portion 130. First portion 110 may comprise a front face 112, a rear face 116, a bottom face 118, and two opposing side faces 114 disposed therebetween. Second portion 120 may comprise a front face 122, a rear face 126, a bottom face 128, and two opposing side faces 124 disposed therebetween. Top portion 130 may comprise a front face 132, a rear face 136, a top face 138 and two opposing side faces 134 disposed therebetween. In one embodiment, the depth of first portion 110 may be different than the depth of second portion 120. The depths of first portion 110 and second portion 120 may be varied as desired to best accept cigarettes of desired dimensions such that the cigarettes are disposed securely within first portion 110 and second portion 120. The depth of top portion 130 may be approximately similar to the sum of the depth of first portion 110 and the depth of second portion 120 such that top portion 130 may enclose both first portion 110 and second portion 120 when cigarette package 100 is in a closed configuration. First portion 110 and second portion 120 may be hingedly coupled via hinge 154. Hinge 154 may facilitate shifting cigarette package 100 between an open configuration and a closed configuration.

First portion 110 may include a sleeve 140 disposed therein, and wrapper 150 may be disposed within sleeve 140. In one embodiment, a first group of cigarettes 160 may be disposed within wrapper 150. Cigarettes 160 may have a desired length and a desired diameter. Sleeve 140 may be configured to fit snugly within first portion 110 and to provide support for first group of cigarettes 160 such that first group of cigarettes 160 is well supported within sleeve 140. The thickness of sleeve 140 may be varied as desired to provide optimal support to first group of cigarettes 160.

Second portion 120 may include a sleeve 142 disposed therein, and wrapper 152 may be disposed within sleeve 142. In one embodiment, a second group of cigarettes 162 may be disposed within wrapper 152. Cigarettes 162 may have a desired length and a desired diameter. Sleeve 142 may be configured to fit snugly within first portion 120 and to provide support for second group of cigarettes 162 such that second group of cigarettes 162 is well supported within sleeve 142. The thickness of sleeve 142 may be varied as desired to provide optimal support to second group of cigarettes 162.

In one embodiment, a platform 146 may be disposed within first portion 110 or within second portion 120. The height of platform 146 may be varied as desired in accordance with the height of cigarettes 160 or cigarettes 162. In one embodiment, platform 146 may have a height such that the height of platform 146 and the height of cigarettes 160 is substantially similar to the height of sleeve 140 or sleeve 142.

Top portion 130 may be hingedly coupled to sliding portion 144. Sliding portion 144 may be slidably disposed within second portion 120 and substantially coplanar to sleeve 142. Sliding portion 144 may facilitate shifting top portion between a raised position and a lowered position. When in a raised position, top portion 130 may be pivoted towards the rear portion of second portion 120 to facilitate shifting cigarette package 100 from a closed configuration to an open configuration.

In a closed configuration, rear face 116 of first portion 110 and front face 122 of second portion 120 may be substantially in contact with each other. Top portion 130 may be in a lowered position such that front face 132 is substantially coplanar with front face 112 of first portion 110 and rear face 136 is substantially coplanar with rear face 126 of second portion 120. In the lowered position, top portion 130 may facilitate maintaining cigarette package 100 in a closed configuration.

In operation, top portion 130 and sliding portion 144 may be slid upwards such that sleeve 140 is exposed. Top portion 130 may then be pivoted rearwards, thereby enabling access to first group of cigarettes 160. First portion 110 may then be pivoted outwards, exposing rear face 116 of first portion 110 and front face 122 of second portion 120, and enabling access to second group of cigarettes 162.

What is claimed is:

1. A cigarette pack for cigarettes of different sizes, comprising:

a first portion defined by a front face, a rear face, a bottom face and two opposing side faces disposed therebetween, the side faces having a first width;

a second portion hingedly coupled to the first portion and defined by a front face, a rear face, a bottom face and two opposing side faces disposed therebetween, the side faces having a second width;

a top portion defined by a front face, a rear face, a top face and two opposing side faces disposed therebetween, the side faces having a width approximately equal to said first width and said second width, said top portion being hingedly coupled to a sliding portion disposed within and slidably coupled to said second portion;

a first sleeve disposed within the first portion, said first sleeve configured to support cigarettes of a first size within said first sleeve;

a second sleeve disposed within second first portion, said second sleeve configured to support cigarettes of a second size within said second sleeve; and a platform for supporting cigarettes disposed within either of said portions, the platform having a height such that the sum of the height of said platform and the height of the cigarettes is approximately similar to the height of said portions.

* * * * *